US010724726B1

(12) United States Patent
Jacobson

(10) Patent No.: US 10,724,726 B1
(45) Date of Patent: Jul. 28, 2020

(54) LIGHT ASSEMBLY INCLUDING AN ADAPTER TO COUPLE TO A WORK IMPLEMENT

(71) Applicant: Nova Wildcat Shur-Line, LLC, St. Francis, WI (US)

(72) Inventor: John Jacobson, Mequon, WI (US)

(73) Assignee: Nova Wildcat Shur-Line, LLC, St. Francis, WI (US)

( * ) Notice: Subject to any disclaimer, the term of this patent is extended or adjusted under 35 U.S.C. 154(b) by 0 days.

(21) Appl. No.: 16/447,425

(22) Filed: Jun. 20, 2019

(51) Int. Cl.

| | |
|---|---|
| ***F21S 6/00*** | (2006.01) |
| ***F21V 27/00*** | (2006.01) |
| ***F21L 4/04*** | (2006.01) |
| ***F21V 21/32*** | (2006.01) |
| ***A47L 13/10*** | (2006.01) |
| ***A46B 15/00*** | (2006.01) |
| *F21Y 113/20* | (2016.01) |
| *F21Y 115/10* | (2016.01) |

(52) U.S. Cl.
CPC ..... *F21V 27/005* (2013.01); *A46B 15/0036* (2013.01); *A47L 13/10* (2013.01); *F21L 4/04* (2013.01); *F21V 21/32* (2013.01); *A46B 2200/302* (2013.01); *F21Y 2113/20* (2016.08); *F21Y 2115/10* (2016.08)

(58) Field of Classification Search
None
See application file for complete search history.

(56) References Cited

U.S. PATENT DOCUMENTS

| | | | |
|---|---|---|---|
| 662,491 | A | 11/1900 | Mead |
| 1,692,394 | A | 11/1928 | Sundh |
| D147,258 | S | 8/1947 | Becker |
| 2,467,954 | A | 4/1949 | Becker |
| 2,778,043 | A | 1/1957 | Ark |
| 3,103,723 | A | 9/1963 | Becker |
| 3,111,277 | A | 11/1963 | Grimsley |
| D240,322 | S | 6/1976 | Staub |
| 4,209,823 | A | 6/1980 | Burkdoll |
| D281,820 | S | 12/1985 | Oba et al. |
| D290,405 | S | 6/1987 | Johns |
| 4,916,773 | A | 4/1990 | McCoy |
| D359,573 | S | 6/1995 | Citronowicz |
| D374,734 | S | 10/1996 | Esposito |
| 6,283,609 | B1 | 9/2001 | Parsons et al. |
| D479,888 | S | 9/2003 | Sharrah et al. |
| D489,839 | S | 5/2004 | Opolka |
| 6,808,289 | B2 | 10/2004 | Reed |

(Continued)

*Primary Examiner* — Vip Patel
(74) *Attorney, Agent, or Firm* — Michael Best & Friedrich LLP

(57) ABSTRACT

A light assembly is configured to connect between a handle and a work implement. The light assembly includes a housing that defines an interior and includes an adapter with a first end, a second end opposite the first end, and a first axis that extends centrally through the adapter between the first and second ends. The first end defines a bore configured to couple to the handle. The second end defines an extension configured to couple to the work implement. A battery receptacle is disposed within the interior of the housing and is configured to receive a battery. An elongated flexible arm extends from the housing and includes a first end adjacent the housing and a second end opposite the first end. A light is disposed at the second end of the elongated flexible arm.

20 Claims, 10 Drawing Sheets

(56) References Cited

U.S. PATENT DOCUMENTS

| | | | | |
|---|---|---|---|---|
| 6,874,908 | B2 | 4/2005 | Sharrah et al. | |
| D524,969 | S | 7/2006 | Shiu | |
| D532,135 | S | 11/2006 | Mills | |
| D536,116 | S | 1/2007 | Sharrah | |
| D563,011 | S | 2/2008 | Major | |
| 7,810,967 | B2 | 10/2010 | Ko et al. | |
| 8,926,117 | B2 | 1/2015 | Blanchette | |
| 9,238,246 | B2 | 1/2016 | Surratt et al. | |
| 9,414,669 | B2 | 8/2016 | Fleischer | |
| 9,638,411 | B2 | 5/2017 | Saltalamacchia | |
| D790,751 | S | 6/2017 | Kaiser | |
| D812,794 | S | 3/2018 | Pickens et al. | |
| 2006/0215391 | A1 | 9/2006 | Jones et al. | |
| 2007/0074358 | A1* | 4/2007 | Tsai | A47L 11/4005 15/42 |
| 2008/0192461 | A1 | 8/2008 | Chien | |
| 2014/0226304 | A1* | 8/2014 | Boyd | F21V 21/32 362/33 |

* cited by examiner

LIGHT ASSEMBLY INCLUDING AN ADAPTER TO COUPLE TO A WORK IMPLEMENT

BACKGROUND

The present invention relates to a light assembly, and in particular to a light assembly adapter.

Performing household duties may require a tool to assist in completing the duty. For example, paintbrushes, brooms, mops, or the like are used to assist in completing the household duties. Often times, while performing household duties, such as cleaning or painting, many areas are poorly lit. In addition, these household duties may be performed during darker time periods of the day or at night. As such, it is often hard to see the area in which the household duty is being performed.

SUMMARY

In one embodiment, the invention provides a light assembly configured to connect between a handle and a work implement. The light assembly includes a housing that defines an interior. The housing includes an adapter. The adapter includes a first end, a second end opposite the first end, and a first axis that extends centrally through the adapter between the first and second ends. The first end defines a bore configured to couple to the handle. The second end defines an extension configured to couple to the work implement. The light assembly also includes a battery receptacle disposed within the interior of the housing. The battery receptacle is configured to receive a battery. The light assembly also includes an elongated flexible arm that extends from the housing. The flexible arm includes a first end adjacent the housing and a second end opposite the first end. The light assembly further includes a light disposed at the second end of the elongated flexible arm.

In another embodiment, the invention provides a light assembly configured to connect between a handle and a work implement. The light assembly includes a housing that defines an interior. The housing includes an adapter. The adapter defines a first end, a second end opposite the first end, and a first axis that extends centrally through the adapter between the first and second ends. The first end is configured to couple to the handle and the second end is configured to couple to the work implement. The light assembly also includes a battery receptacle disposed within the interior of the housing. The battery receptacle defines a longitudinal axis that extends centrally through the battery receptacle. The longitudinal axis is parallel to and offset from the first axis. The light assembly also includes an elongated flexible arm that extends from the housing. The flexible arm includes a first end adjacent the housing and a second end opposite the first end. The light assembly further includes a light disposed at the second end of the elongated flexible arm.

In another embodiment the invention provides a system including a handle configured to be grasped by a user with an engagement end. The system also includes a light assembly having a housing that defines an interior and includes an adapter with a first end coupled to the engagement end of the handle, a second end opposite the first end, and a first axis extending centrally through the adapter between the first and second ends. The light assembly also includes an elongated flexible arm that extends from the housing. The elongated flexible arm includes a first end adjacent the housing and a second end opposite the first end. The light assembly also includes a battery receptacle disposed within the interior of the housing. The battery receptacle is configured to receive a battery. The light assembly further includes a light disposed at the second end of the elongated flexible arm. The system further includes a work implement coupled to the second end of the adapter.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
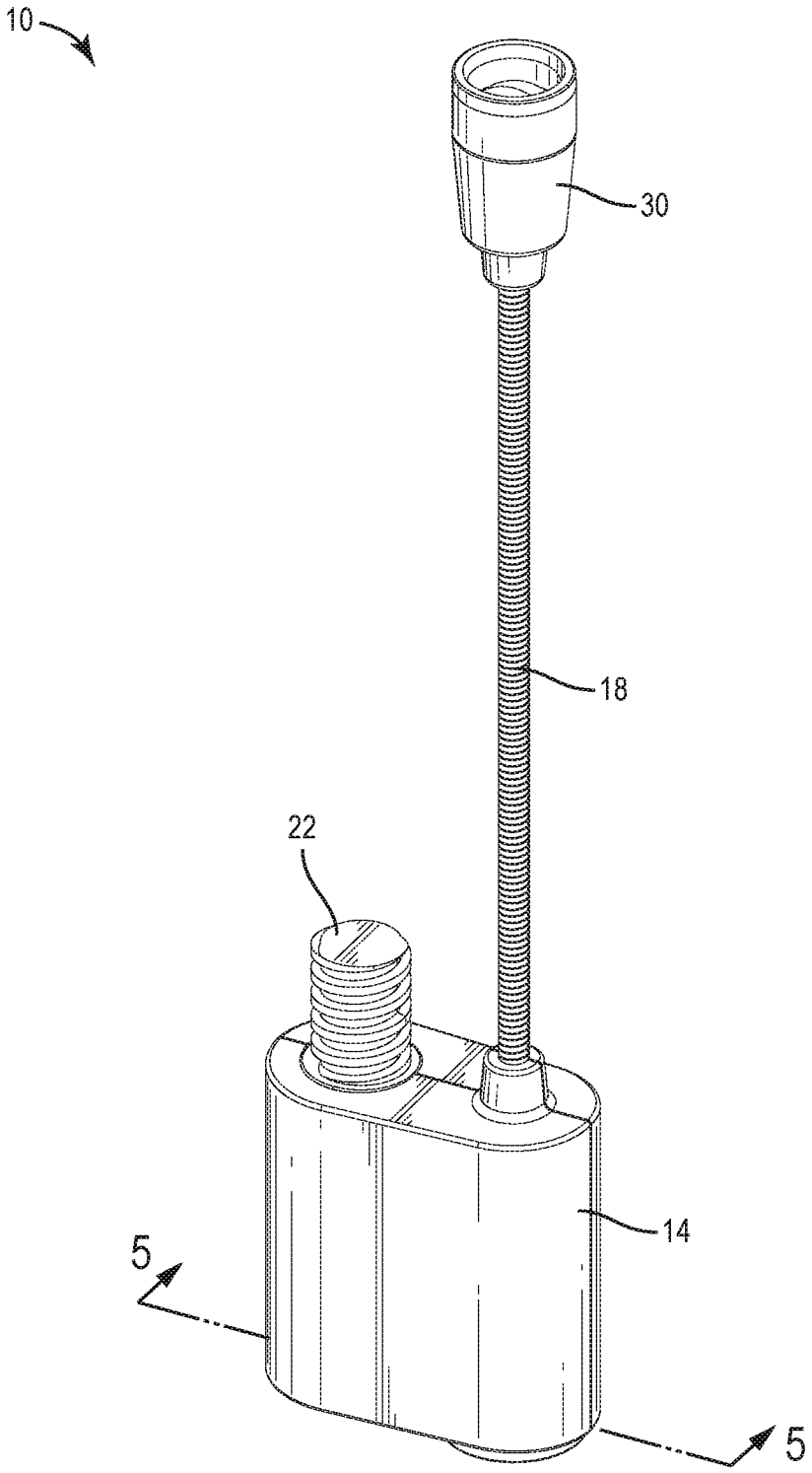
FIG. 1 is a perspective view of a light assembly.
Figure 2:
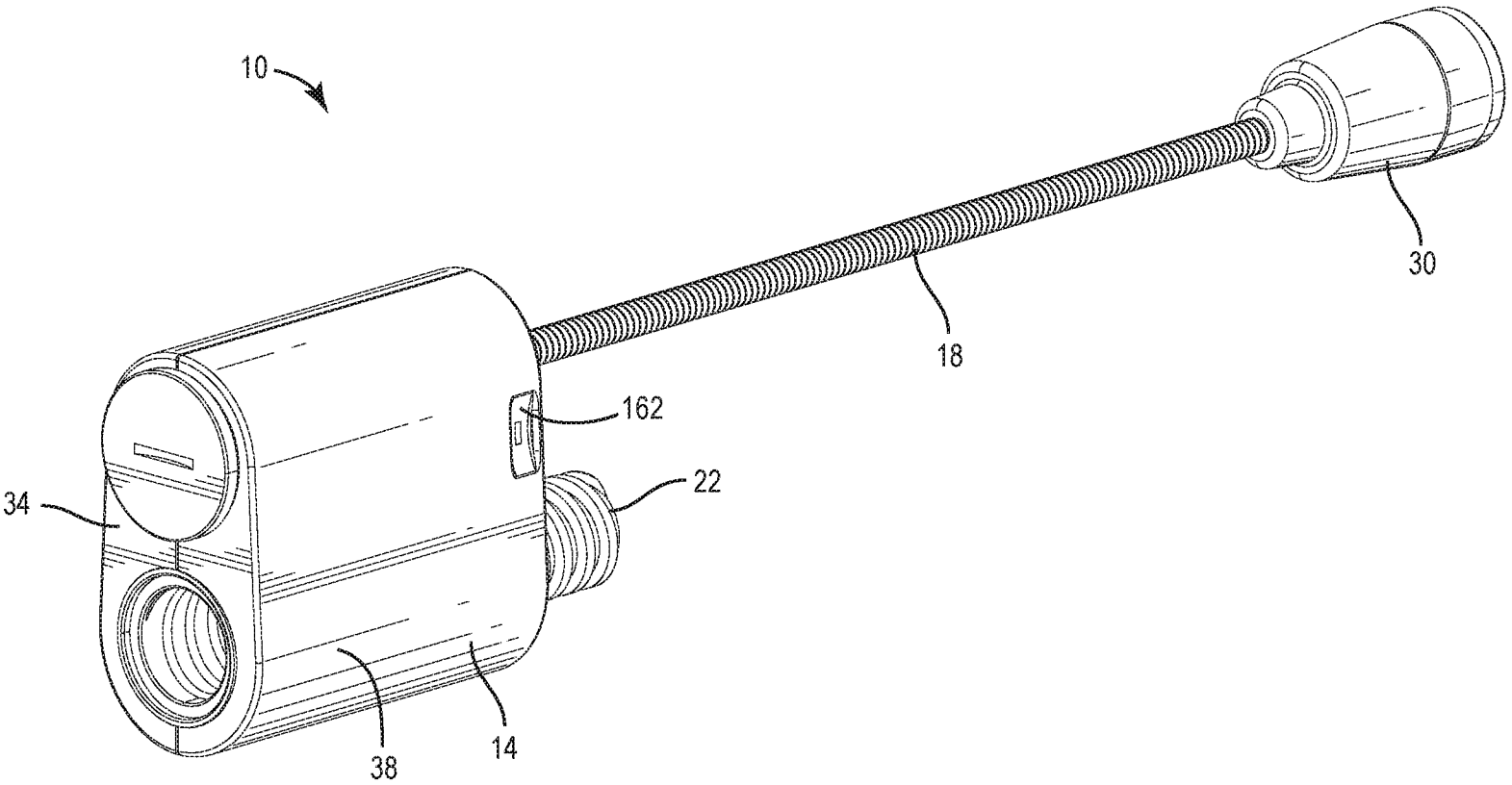
FIG. 2 is a second perspective view of the light assembly.

FIGS. 1 and 2 illustrate a light assembly 10. The illustrated light assembly 10 is configured to be coupled to a work implement, such as, for example, painting devices like paint brushes, paint edgers, paint rollers, and the like. The light assembly 10 may also be used with work implements that are cleaning devices, such as brooms, mops, dusters, and the like. In addition, the light assembly 10 may be configured to couple to other types of work implements such as tools, extension hooks, suction cups (e.g., for changing high light bulbs), nets, shovels, and the like. The illustrated light assembly 10 includes a housing 14, an elongated flexible arm 18, a battery receptacle 26 (FIG. 3), and a light 30.

Figure 3:
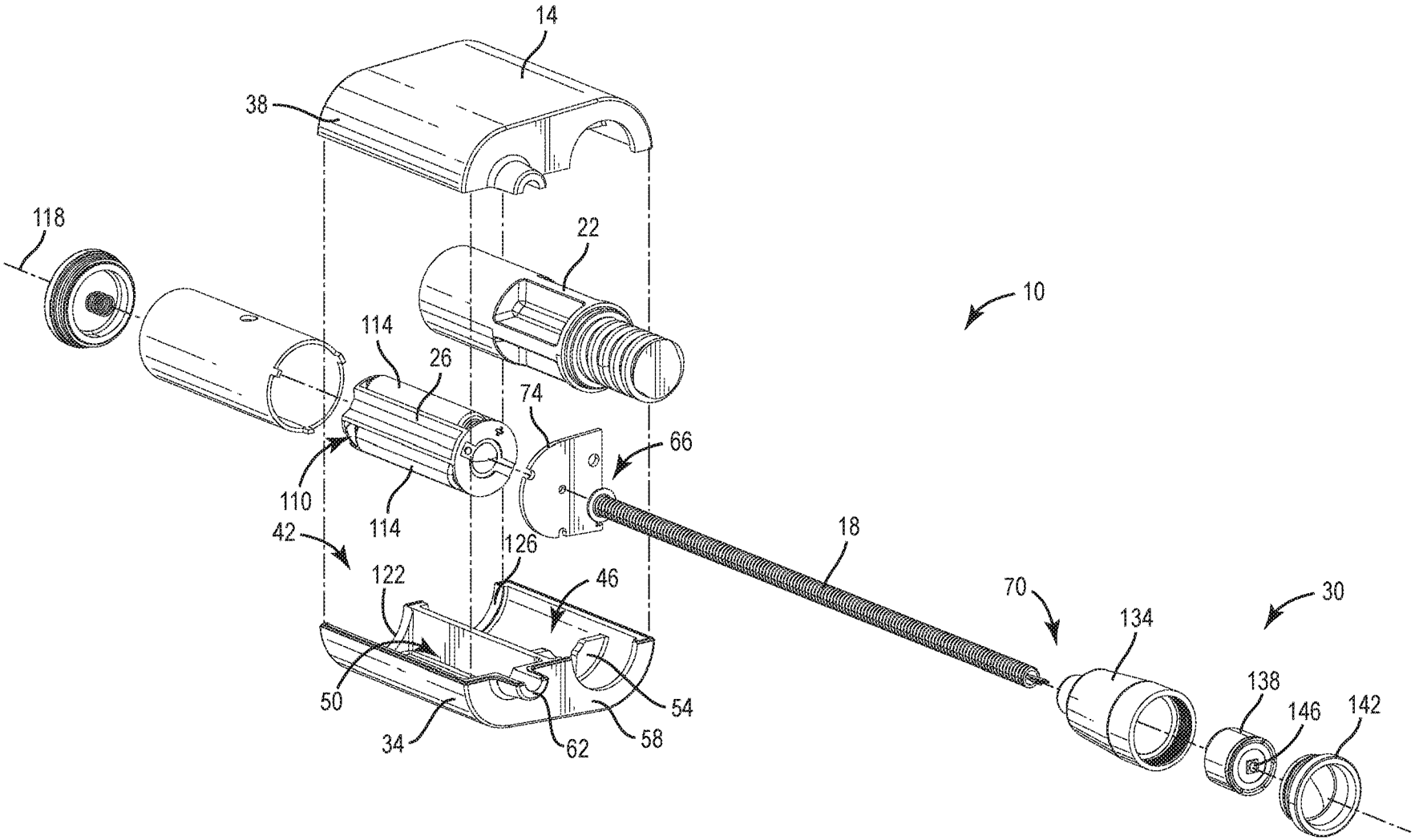
FIG. 3 is an exploded view of the light assembly.

With reference to FIG. 3, the housing 14 includes an outer shell comprised of a first portion 34 and a second portion 38. The illustrated housing 14 also includes an adapter 22 positioned within the outer shell. The first and second portions 34, 38 couple together to define an interior 42 of the housing 14. In the illustrated embodiment, the interior 42 of the housing 14 is divided by the outer shell into a first compartment 46 and a second compartment 50 that is adjacent to the first compartment 46. The first compartment 46 receives the adapter 22, and the second compartment 50 receives the battery receptacle 26. In the illustrated embodiment, the outer shell (e.g., the first and second portions 34, 38) and the adapter 22 are separate pieces that are secured together. The first portion 34 of the housing 14 includes a retainer 54 that secures the adapter 22 within the first compartment 46 of the housing 14. When coupled together, the first portion 34 and the second portion 38 of the housing 14 form a collar 58 from which the adapter 22 extends. In addition, the first and second portions 34, 38 define a neck 62 from which the elongated flexible arm 18 extends. In other embodiments, the outer shell and the adapter 22 may be integrally formed as a single piece.

With continued reference to FIG. 3, the flexible elongated arm 18 includes a first end 66 and a second end 70 opposite the first end 66. The first end 66 of the elongated flexible arm 18 is coupled to an electrical connector 74 of the battery receptacle 26. As such, the first end 66 of the elongated flexible arm 18 is fixed relative to the housing 14. The first end 66 also extends through the neck 62 of the housing 14. The elongated flexible arm 18 is bendable, allowing for repositioning of the second end 70 of the elongated flexible arm 18 relative to the housing 14. The elongated flexible arm 18 is flexible, but sturdy enough to maintain a position that the flexible arm 18 is moved to. For example, the second end 70 of the elongated flexible arm 18 may be moved to a variety of angles and/or positions relative to the housing 14 while the first end 66 remains fixed. As such, the second end 70 of the elongated flexible arm 18 is freely movable.

Figure 8:
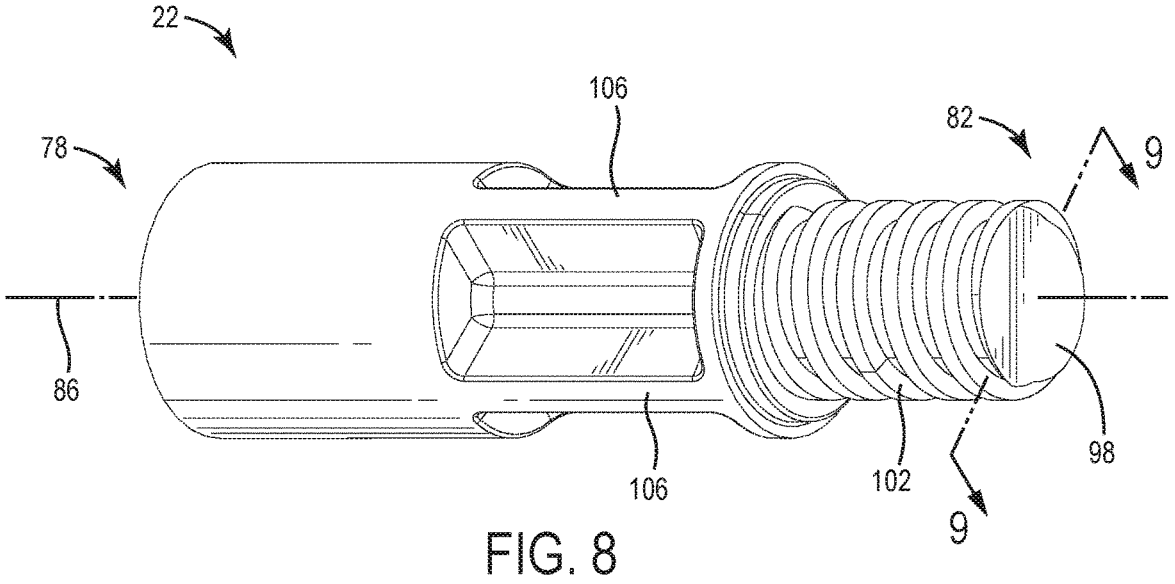
FIG. 8 is a perspective view of an adapter of the light assembly.
Figure 9:
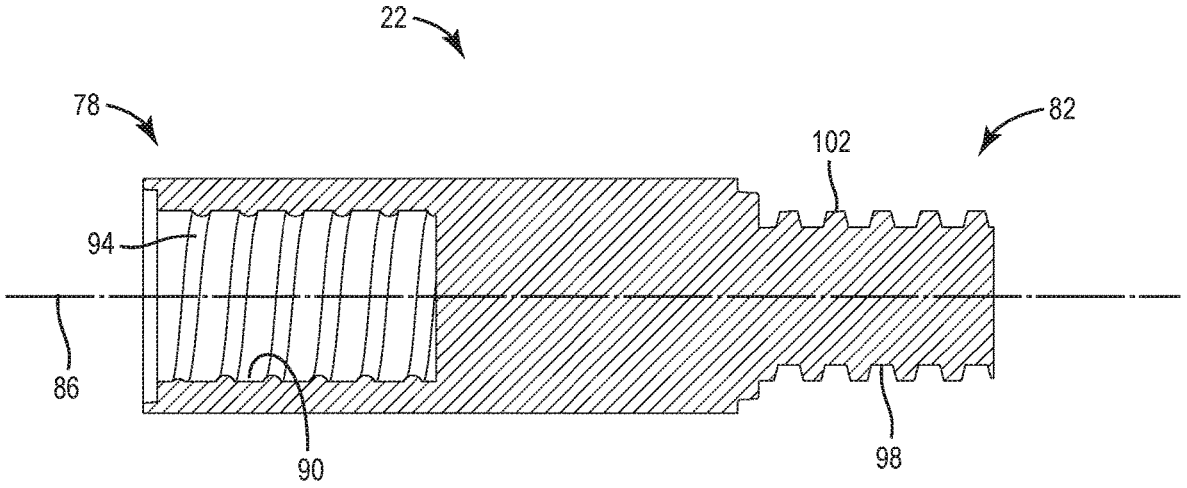
FIG. 9 is a cross-sectional view of the adapter taken along section line 9-9 of FIG. 8.

With reference to FIGS. 8 and 9, the adapter 22 of the housing 14 includes a first end 78, a second end 82 opposite the first end 78, and an adapter axis 86 extending centrally through the adapter 22 between the first and second ends 78, 82. In the illustrated embodiment, the first end 78 of the adapter 22 defines a bore 90 (FIG. 9) with internal threads 94 and the second end 82 of the adapter 22 defines an extension 98 with external threads 102. The extension 98 and the bore 90 are axially aligned along the adapter axis 86. The diameter of the bore 90 and the diameter of the extension 98 are substantially similar in size. As such, the bore 90 and the extension 98 complement each other. In other words, an extension 98 from another adapter or a similar extension from a work implement is operable to screw into the bore 90 using threads to couple the work implement and light assembly 10 together. Similarly, a bore from another adapter or a similar bore from a work implement is operable to screw onto the extension 98 to couple the work implement to the light assembly 10. The illustrated adapter 22 further includes ribs 106 (FIG. 8) that correspond to the retainer 54 of the first portion 34 of the housing 14 to position and secure the adapter 22 within the housing 14.

With reference to FIG. 3, the battery receptacle 26 is generally cylindrical and includes slots 110. Each slot 110 is configured to receive a battery 114. In the illustrated embodiment, the battery receptacle 26 includes three slots 110 that are evenly spaced about the battery receptacle 26. In other embodiments, the battery receptacle 26 may include fewer than three slots 110 or more than three slots 110 to receive fewer or more batteries 114. In the illustrated embodiment, the slots 110 are configured to receive AAA batteries. In other embodiments, the slots 110 may receive other sized batteries. The battery receptacle 26 defines a longitudinal axis 118 that extends centrally through the battery receptacle 26. The longitudinal axis 118 is also an insertion axis along which the battery receptacle 26 can be inserted into and removed from the housing 14. As discussed above, the battery receptacle 26 also includes the electrical connector 74 to provide power from the batteries 114 to the light 30.

Figure 4:
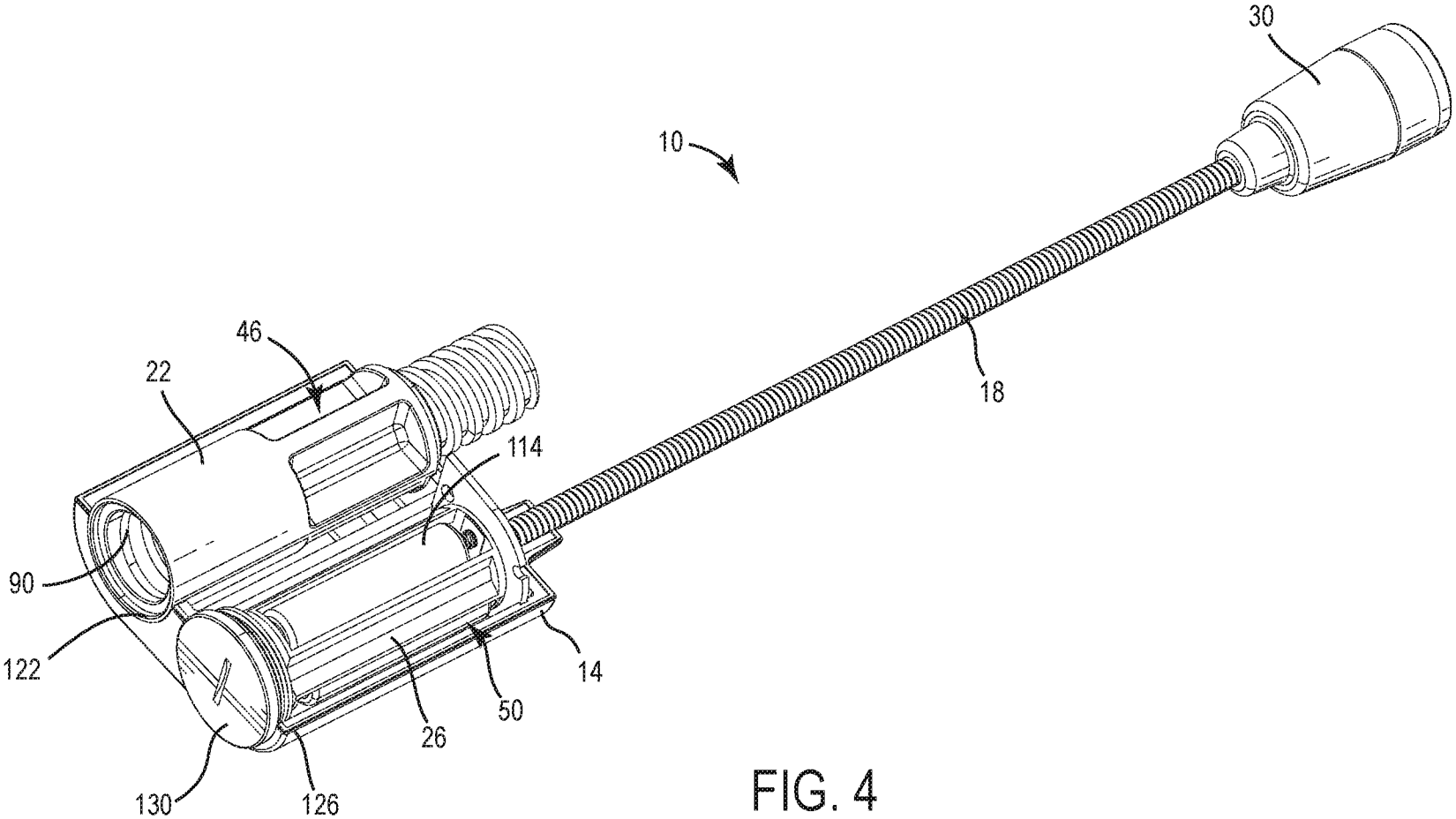
FIG. 4 is a perspective view of the light assembly of FIG. 1 with a portion of a housing removed.

Referring to FIGS. 3 and 4, the housing 14 defines a first opening 122 that extends into the first compartment 46 and a second opening 126 that extends into the second compartment 50. The first opening 122 allows access to the bore 90 of the adapter 22 for a handle to be coupled to the bore 90. The second opening 126 allows access to the battery receptacle 26 within the second compartment 50. As such, the battery receptacle 26 is removable from the housing 14, for example, to replace the batteries 114. A battery cover 130 (FIG. 4) is threadably secured to the second opening 126 to retain the battery receptacle 26 within the housing 14.

Figure 6:
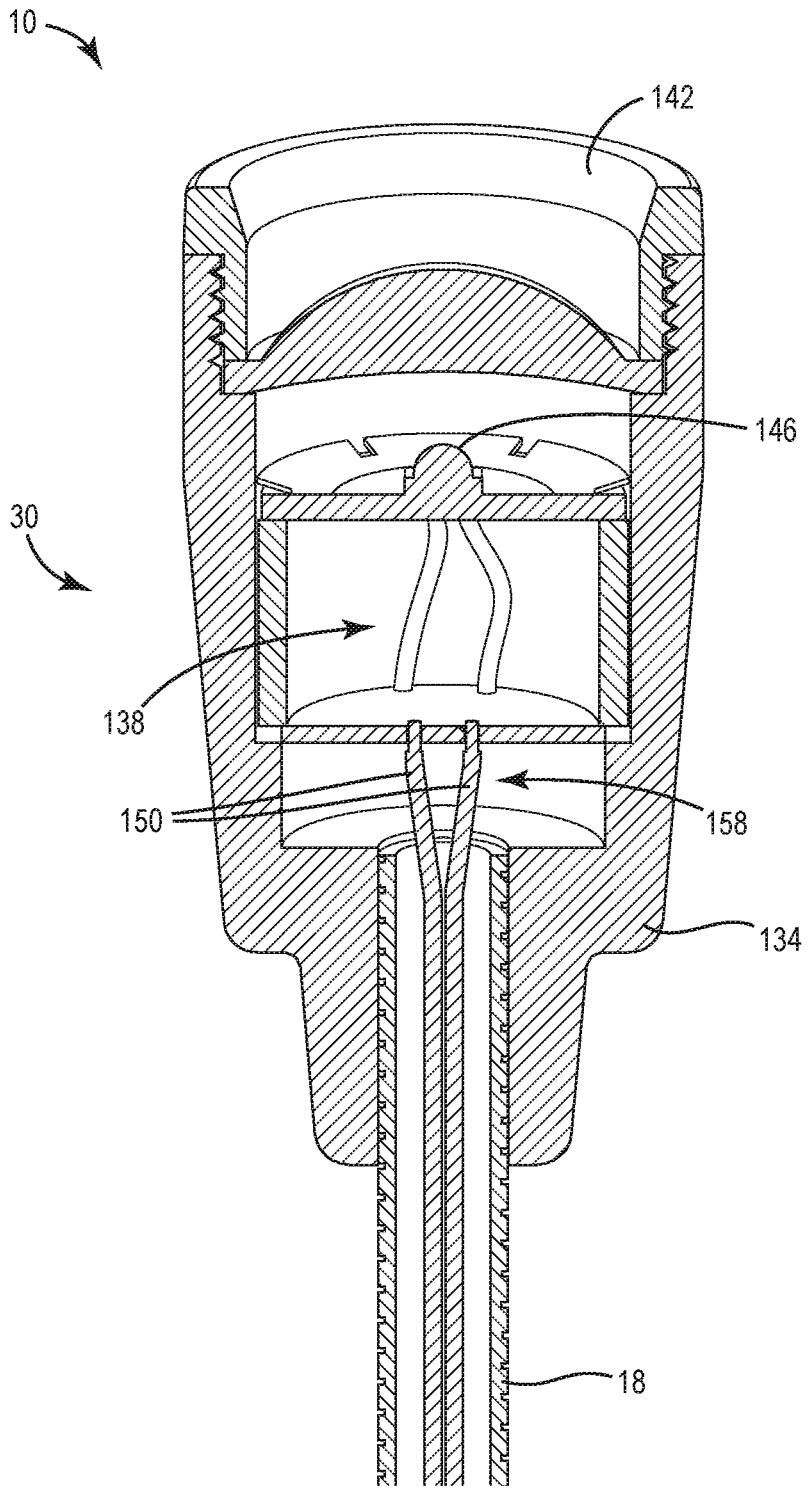
FIG. 6 is a cross-sectional view of a portion of the light assembly taken along section line 5-5 of FIG. 1.

With reference to FIGS. 3 and 6, the light 30 is positioned adjacent the second end 70 of the elongated flexible arm 18. The light 30 includes a light seat 134, an LED assembly 138, and a lens 142. The light seat 134 extends around the elongated flexible arm 18. The LED assembly 138 is nested in the light seat 134 and includes a single LED 146 (light emitting diode) that illuminates when power is provided by the batteries 114. In other embodiments, the light 30 may include other light sources that are not an LED. In further embodiments, the light 30 may include more than one LED or light source. The lens 142 is threadably coupled to the light seat 134 to secure the LED assembly 138 within the light seat 134. The lens 142 protects the LED 146 and diffuses light emitted by the LED 146 to an area surrounding the light assembly 10.

Figure 5:
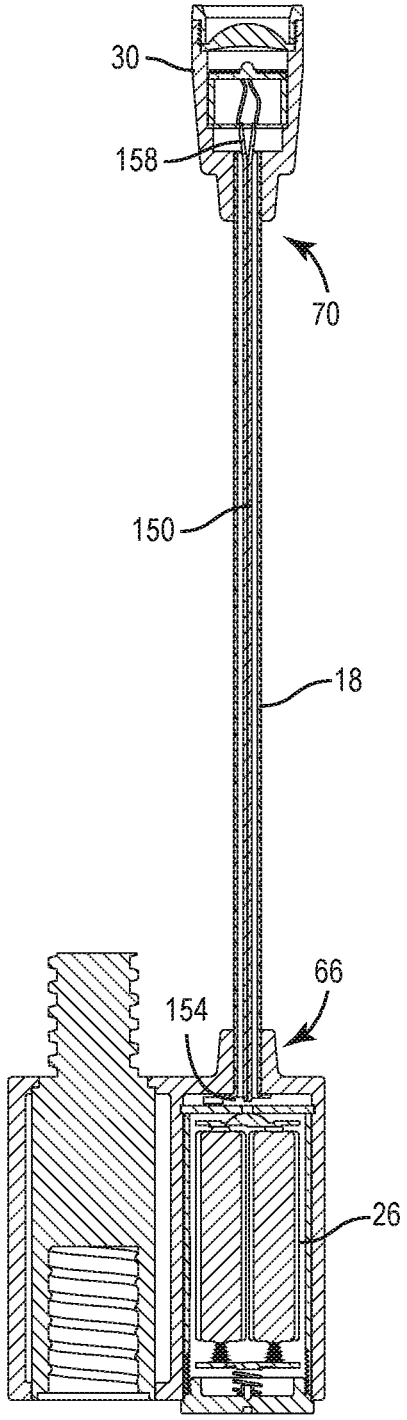
FIG. 5 is a cross-sectional view of the light assembly taken along section line 5-5 of FIG. 1.
Figure 7:
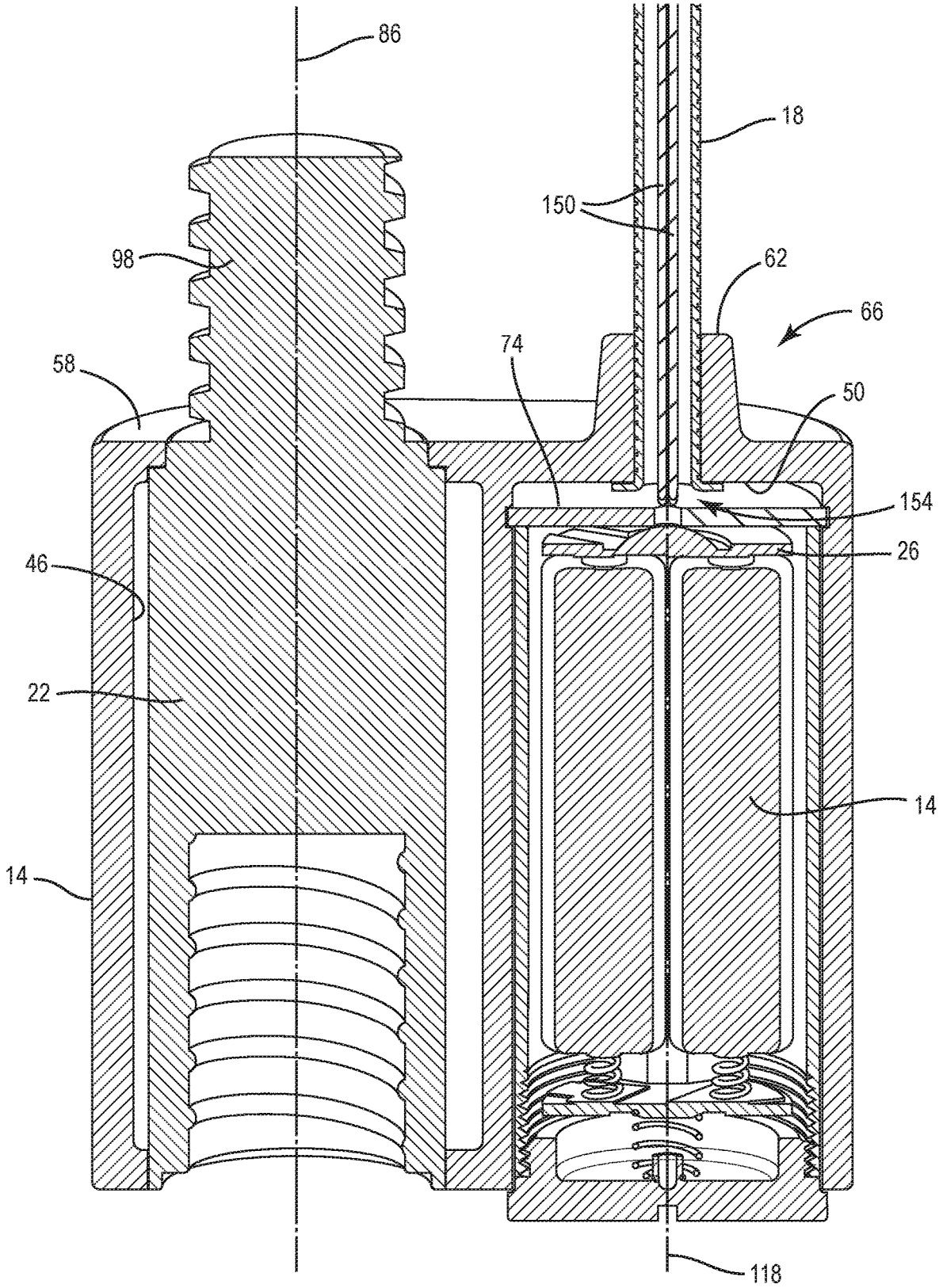
FIG. 7 is a cross-sectional view of another portion of the light assembly taken along section line 5-5 of FIG. 1.

As shown in FIG. 5, electrical conductors 150 extend from the battery receptacle 26 to the light 30. In the illustrated embodiment, the light assembly 10 includes two electrical conductors 150. In other embodiments, the light assembly 10 may include more than two electrical conductors 150 or less than two electrical conductors 150. The electrical conductors 150 extend through the elongated flexible arm 18 between the first and second ends 66, 70. The electrical conductors 150 also include a first end 154 adjacent the electrical connector 74 of the battery receptacle 26 and a second end 158 opposite the first end 154 and adjacent the light 30. Moving to FIG. 6, the second end 158 of the electrical conductors 150 couple to the LED assembly 138 to provide power to the LED 146. As shown in FIG. 7, the first end 154 of the electrical conductors 150 are coupled to the electrical connector 74.

An actuator 162 (FIG. 2) is positioned on the second portion 38 of the housing 14 to selectively provide power from the batteries 114 to the light 30. In the illustrated embodiment, the actuator 162 is a slider switch. In other embodiments, the actuator 162 may be a depressible button, a rotary dial, and the like. When a user switches the actuator 162, electrical power is provided by the batteries 114. The electrical power is transferred through the electrical connector 74 of the battery receptacle 26 to the electrical conductors 150. The electrical power runs through the electrical conductors 150 from the first end 154 to the second end 158 to transfer the power to the LED assembly 138. The electrical power illuminates the LED 146 to provide light to the surrounding areas of the light assembly 10. In some embodiments, the actuator 162 may be operable to different positions to operate the LED 146 in different modes (e.g., a high beam, a low beam, and off).

As shown in FIG. 7, the adapter axis 86 is parallel and offset from the longitudinal axis 118. The longitudinal axis 118 extends through the first end 66 of the elongated flexible arm 18. As such, the first end 66 of the elongated flexible arm 18 is offset from the adapter axis 86. Although as illustrated, the longitudinal axis 118 extends through the flexible arm 18, when the second end 70 of the flexible arm 18 is repositioned, the longitudinal axis 118 may only extend partially through the elongated flexible arm 18.

Figure 10:
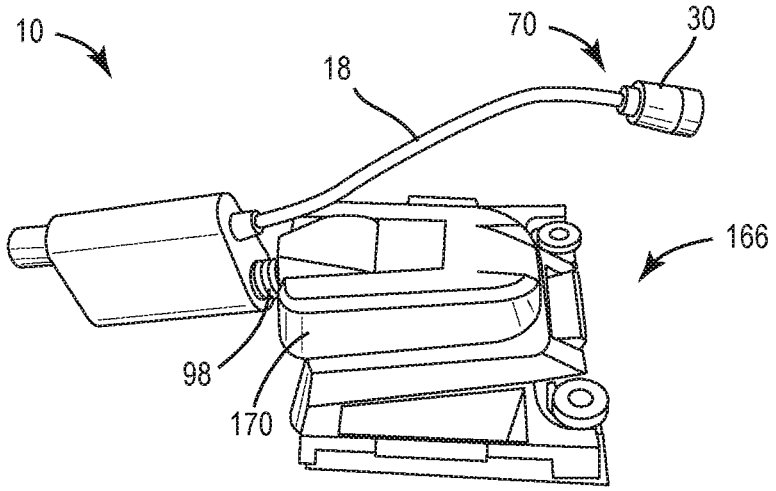
FIG. 10 is a perspective view of the light assembly in use with a paint edger.

FIG. 10 illustrates the light assembly 10 in use with a work implement. Specifically, FIG. 10 illustrates the light assembly 10 coupled to a paint edger 166. The paint edger 166 may include an adapter 170 with a bore that corresponds to the extension 98 of the adapter 22. A user may couple the adapter 22 to the paint edger 166 by screwing the extension 98 into a bore on the paint edger 166. A user may then switch the actuator 162 as described above to provide power to the light 30 to illuminate the area around the paint edger 166. Depending on the light needs, a user may adjust or reposition the second end 70 of the elongated flexible arm 18 to position the light 30 in an optimal position for a user to see a workpiece that is being painted.

Figure 11:
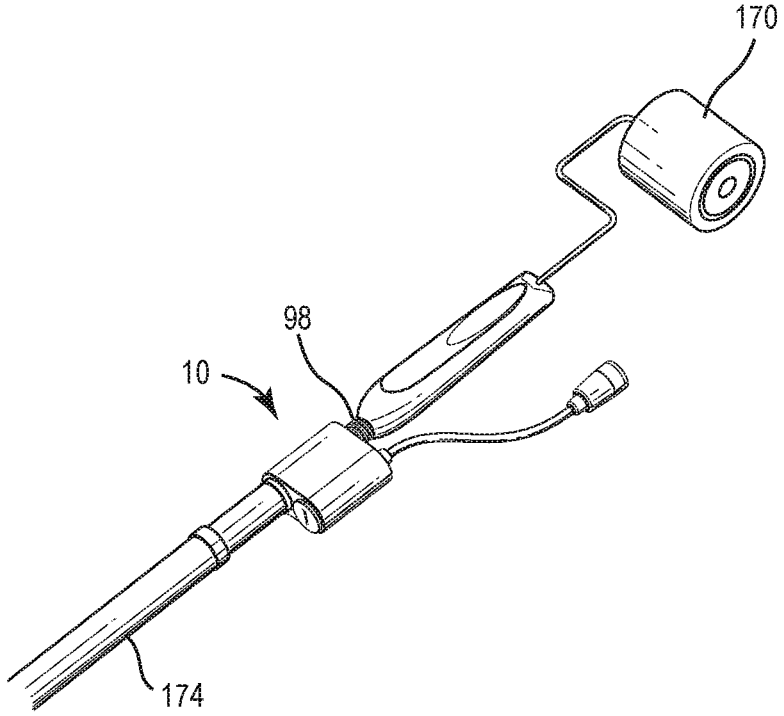
FIG. 11 is a perspective view of the light assembly in use with a paint roller.
Figure 12:
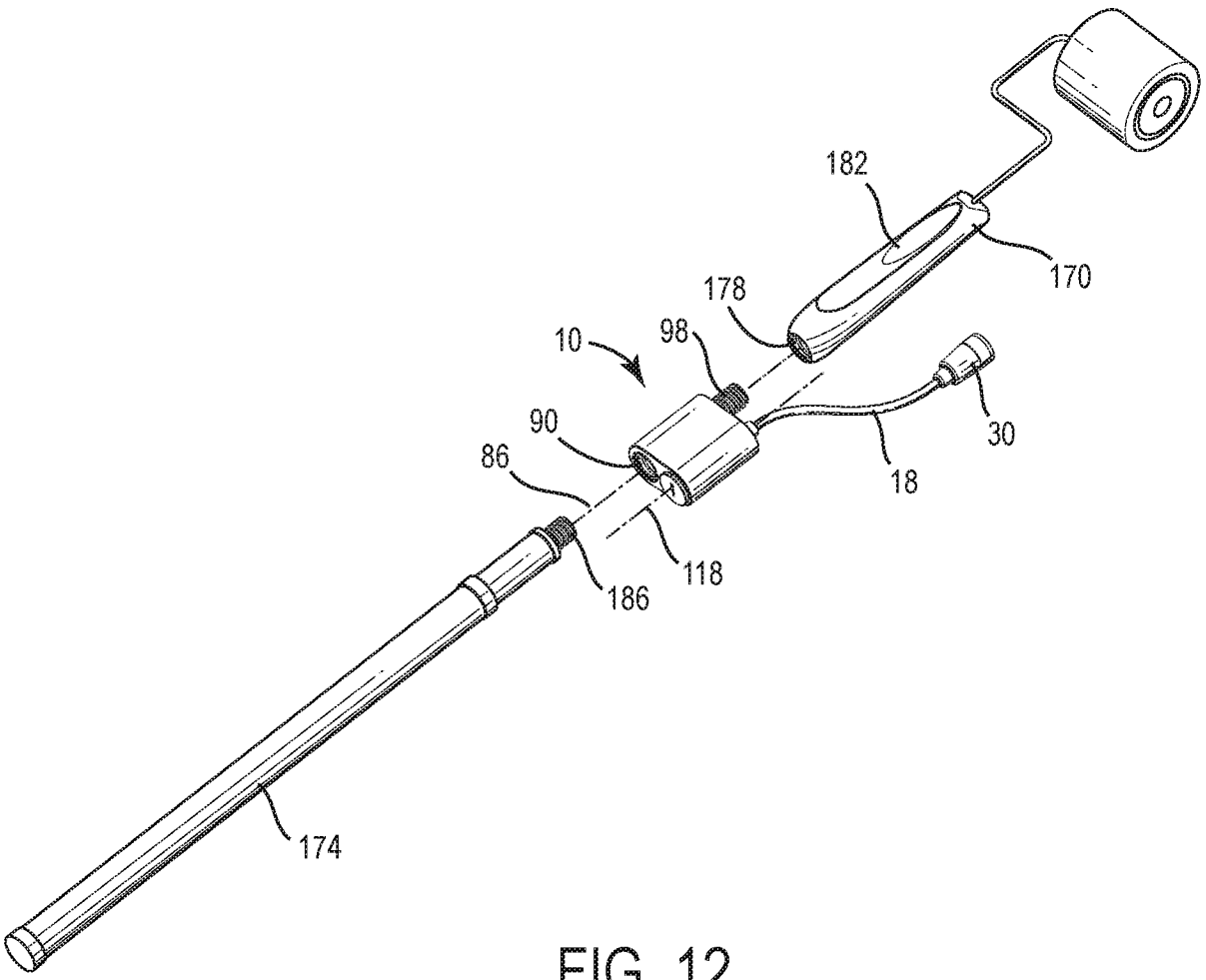
FIG. 12 is an exploded view of the light assembly and the paint roller of FIG. 11.

FIGS. 11 and 12 illustrate the light assembly 10 in use with a work implement. Specifically, the light assembly 10 is coupled to a paint roller 170 and a handle 174. Now referring to FIG. 12 the extension 98 of the adapter 22 is coupled to a bore 178 with internal threads on a handle 182 of the paint roller 170 to couple the light assembly 10 to the paint roller 170. The handle 174 includes an engagement end 186 with external threads that corresponds to the internal threads of the bore 90 of the adapter 22. The handle 174 may be coupled to the bore 90 of the light assembly 10 to provide a user with greater range to use the paint roller 170 while still being able to use the light assembly 10. Similarly, the handle 174 may be coupled to the light assembly 10 to extend the range of any work implement or tool that the light assembly 10 is simultaneously coupled too. Although the illustrated handle 174 includes an elongated shaft that extends the reach of the paint roller 170, in other embodiments, the handle 174 and/or the handle 182 may be relatively shorter so the overall system has a similar length to a standard paint roller.

In other embodiments, the light assembly 10 may be coupled to a second work implement or tool instead of the handle 174. When the light assembly 10 is coupled to the handle 174, the handle 174 and the work implement are axially aligned with the adapter axis 86. As such, a user may easily and intuitively control the work implement as if the light assembly 10 was not present. The longitudinal axis 118 is parallel to and offset from the handle 174 and the work implement. As such, the light 30 may be easily repositioned around the work implement without being blocked by the work implement. A user may use the light assembly 10 with the paint roller 170 or other work implements in a similar manner as described above with respect to the paint edger 166.

Various features and advantages of the invention are set forth in the following claims.

What is claimed is:

1. A light assembly configured to connect between a handle and a work implement, the light assembly comprising:

a housing defining an interior, the housing including an adapter, the adapter including a first end, a second end opposite the first end, and a first axis extending centrally through the adapter between the first and second ends, the first end defining a bore configured to couple to the handle, the second end defining an extension configured to couple to the work implement;

a battery receptacle disposed within the interior of the housing, the battery receptacle configured to receive a battery;

an elongated flexible arm extending from the housing, the flexible arm including a first end adjacent the housing and a second end opposite the first end; and a light disposed at the second end of the elongated flexible arm.

2. The light assembly of claim 1, wherein the bore and the extension are axially aligned along the first axis.

3. The light assembly of claim 1, wherein the bore includes internal threads and the extension includes external threads.

4. The light assembly of claim 1, wherein the battery receptacle is configured to receive three batteries.

5. The light assembly of claim 1, wherein the first end of the elongated flexible arm is fixed relative to the housing and the second end of the elongated flexible arm is moveable relative to the housing.

6. The light assembly of claim 1, wherein the battery receptacle defines a longitudinal axis extending centrally through the battery receptacle, and wherein the first axis is parallel to the longitudinal axis.

7. The light assembly of claim 6, wherein the first axis is offset from the longitudinal axis.

8. The light assembly of claim 7, wherein the first end of the flexible arm is aligned with the longitudinal axis and offset from the first axis.

9. The light assembly of claim 1, wherein the light includes a single LED.

10. The light assembly of claim 1, further comprising an actuator positioned on the housing to selectively power the light.

11. The light assembly of claim 1, wherein the housing includes an outer shell that separates the interior of the housing into a first compartment and a second compartment, wherein the adapter is disposed within the first compartment, and wherein the battery receptacle is disposed in the second compartment.

12. A light assembly configured to connect between a handle and a work implement, the light assembly comprising:

a housing defining an interior; the housing including an adapter, the adapter defining a first end, a second end opposite the first end, and a first axis extending centrally through the adapter between the first and second ends, the first end configured to couple to the handle and the second end configured to couple to the work implement;

a battery receptacle disposed within the interior of the housing, the battery receptacle defining a longitudinal axis extending centrally through the battery receptacle, the longitudinal axis being parallel to and offset from the first axis;

an elongated flexible arm extending from the housing, the flexible arm including a first end adjacent the housing and a second end opposite the first end; and a light disposed at the second end of the elongated flexible arm.

13. The light assembly of claim 12, wherein the light includes a single LED.

14. The light assembly of claim 12, wherein the first end of the flexible arm is aligned with the longitudinal axis.

15. A system comprising:

a handle configured to be grasped by a user, the handle having an engagement end;

a light assembly including a housing defining an interior and including an adapter, the adapter having a first end coupled to the engagement end of the handle, a second end opposite the first end, and a first axis extending centrally through the adapter between the first and second ends, an elongated flexible arm extending from the housing, the elongated flexible arm including a first end adjacent the housing and a second end opposite the first end, a battery receptacle disposed within the interior of the housing, the battery receptacle configured to receive a battery, and a light disposed at the second end of the elongated flexible arm; and a work implement coupled to the second end of the adapter.

16. The system of claim 15, wherein the first end of the adapter defines a bore that receives the engagement end of the handle, and wherein the second end of the adapter defines an extension that is received in a corresponding bore of the work implement.

17. The system of claim 16, wherein the bore of the adapter threadably engages the engagement end of the handle, and wherein the corresponding bore of the work implement threadably engages the extension of the adapter.

18. The system of claim 15, wherein the first end of the elongated flexible arm is fixed relative to the housing, and wherein the second end of the elongated flexible arm is moveable relative to the housing.

19. The system of claim 15, wherein the handle is axially aligned with the first axis.

20. The system of claim 19, wherein the first end of the elongated flexible arm is offset from the first axis.

* * * * *